428-408 SR

3/15/83 OR 4,376,804

United States Patent [19]

Katzman

[11] 4,376,804

[45] Mar. 15, 1983

[54] PYROLYZED PITCH COATINGS FOR CARBON FIBER

[75] Inventor: Howard A. Katzman, Los Angeles, Calif.

[73] Assignee: The Aerospace Corporation, Los Angeles, Calif.

[21] Appl. No.: 296,958

[22] Filed: Aug. 26, 1981

[51] Int. Cl.[3] ..... B32B 9/00; B32B 9/04; B05D 3/12; B05D 3/02

[52] U.S. Cl. ..... 428/408; 427/57; 427/226; 427/314; 427/430.1; 428/389; 428/446; 428/448; 428/469; 428/902

[58] Field of Search ..... 427/226, 57, 255.6, 427/431, 408, 314, 430.1; 428/610, 614, 627, 634, 469, 689, 389, 902, 446, 448

[56] References Cited

U.S. PATENT DOCUMENTS

| | | | |
|---|---|---|---|
| 3,860,443 | 1/1975 | Lachman et al. | 427/214 |
| 4,082,864 | 4/1978 | Kendall et al. | 427/253 X |
| 4,223,075 | 9/1980 | Harrigan et al. | 428/634 X |

*Primary Examiner*—Michael R. Lusignan

*Attorney, Agent, or Firm*—Ronald L. Taylor

[57] ABSTRACT

Carbon fibers in a carbon-fiber-reinforced metal-matrix composite having a relatively very high modulus are treated with a relatively thin amorphous carbon coating precedent to a metal-oxide film to improve the adhesion thereof to the carbon fiber thereby facilitating the wetting of carbon fibers to molten matrix metal.

22 Claims, No Drawings

PYROLYZED PITCH COATINGS FOR CARBON FIBER

STATEMENT OF GOVERNMENT INTEREST

The invention described herein may be manufactured and used by or for the Government of the United States for governmental purposes without the payment of royalty therefor.

CROSS REFERENCE TO A RELATED PATENT APPLICATION

A patent application entitled, "Carbon-Reinforced Metal-Matrix Composites" bearing application No. 296,957, and filed on Aug. 26, 1981, by Howard A. Katzman and assigned to The Aerospace Corporation describes and claims an improvement process upon which the present case is the basic process therefor.

BACKGROUND OF THE INVENTION

1. Field of the Invention

This invention relates generally to the field of carbon fiber reinforced metal matrix composites and specifically to fiber coatings that enhance wettability without degradation when immersed in molten metal.

2. Prior Art

In the past, a basic problem with carbon-fiber-reinforced metal matrix composites has been that the carbon or graphite-fibers resist wetting when immersed in the molten metal baths used to form the metal matrix. As a result, the fibers would have to be coated with a film that facilitated wetting and, in addition, also protected the fibers against chemical degradation during process and use. The currently used process relies upon the chemical vapor deposition of a thin film of titanium and boron to facilitate wetting as described in U.S. Pat. Nos. 4,223,075 of Sept. 16, 1980 to Harrigan, Jr. et al, 3,860,443 of Jan. 14, 1975 to Lachman et al, and 4,082,864 of Apr. 4, 1978 to Kendall et al. Although meritorious in concept, it is relatively expensive and inconsistent as to results.

As an improvised and novel alternative to the supra chemical vapor deposition, the recently invented process as noted supra by the same inventor entitled, "Carbon-Reinforced Metal-Matrix Composites" filed on Aug. 26, 1981 and having U.S. Ser. No. 296,957, uses a relatively thin metal-oxide coating that is deposited on the fiber surfaces by passing the fiber bundles through an organometallic solution followed by hydrolysis or pyrolysis of the organometallic compound to yield the desired coating. The oxide-coated fibers are readily wetted by a molten metal. The above mentioned metal-oxide technique yields improved results for carbon or graphite fibers having relatively high strength and low modulus such as T300 graphite fiber produced by Union Carbide Corp. which is made from polyacrylonitrile (PAN) precursor which has a stiffness of approximately $35\times10^6$ psi. Recently, carbon fibers having relatively high moduluses, such as P100 graphite fiber produced by Union Carbide Corp. which is made from mesophase pitch which has a stiffness of approximately $100\times10^6$ psi, have been fabricated. These relatively high modulus P100 fibers having a surface metal-oxide coating when immersed in a molten metal such as magnesium have been found to have relatively very little magnesium adhered to the fibers. Scanning Auger Microprobe (SAM) analysis reveals that immersion in liquid magnesium causes the metal-oxide coating to separate from the fibers, indicating that the metal-oxide coating does not adhere to the P100 fibers as well as to the T300 fibers. The difference in adhesion to the two fibers is due to the difference in both the surface morphology and chemical reactivity of the two fibers. The T300 fiber surfaces are rougher and more porous than the P100 surfaces. The P100 relatively high modulus fibers are more graphitic and this results in a smoother more chemically inert and less adhesive surface for the coating. Accordingly, there existed a need for treating relatively high modulus fibers so as to improve the adhesion of the metal oxide coating thereto when immersed in a molten metal.

SUMMARY OF THE INVENTION

It is an important object of the invention to deposit an amphorous carbon coating on the surface of a carbon fiber having a relatively high modulus to simulate the surface of a relatively low modulus fiber thereby enhancing the adhesion of a metal oxide coating thereto.

It is a further object of the invention to deposit the amorphous coating on the surfaces of the carbon fiber by pyrolyzing petroleum pitch thereon.

It is yet another object of the invention to use carbon fibers that are substantially graphite.

DESCRIPTION OF THE PREFERRED EMBODIMENT

The fibers used in the present inventive embodiment are graphite fibers with a relatively high modulus of $100\times10$ psi that are commercially manufactured by Union Carbide Corporation under the trade name "P100". The graphite fibers are manufactured by a process that uses a mesophase pitch precursor. A typical strand of graphite yarn consists of 1,000 to 2,000 continuous filaments or multifilaments each of approximately seven to eleven microns in diameter. The application of the present invention is not limited to P100 graphite fibers, but could be used also on any fiber used in a fiber-reinforced metal matrix composition.

The present invention concerns a means and method for improving the adhesion between high modulus fibers, such as P100 graphite, and a metal-oxide film, such as silicon-dioxide. This is accomplished by the introduction of a coating of amorphous carbon on the surface of the P100 fiber that is relatively smooth and chemically inert that simulates the morphology and chemical reactivity of a lower modulus fiber such as T300 graphite that has a rough and porous surface. This allows the metal-oxide film to adhere to the fiber surface through the medium of the amphorous carbon coating without degrading through time when immersed in a molten metal bath used to form the metal matrix.

Specifically, a relatively thin amorphous carbon coating is deposited on the P100 graphite fibers. This coating causes the P100 graphite fiber surfaces to resemble the rough and porous surface of the T300 fiber, to which the metal oxide film adheres very well. The carbon coating is applied to the P100 graphite fibers by passing the fiber bundles through an organic solvent such as a toluene solution of petroleum pitch followed by evaporation of the organic solvent and pyrolysis of the petroleum pitch to yield a relatively thin amorphous carbon coating. The relatively high modulus fibers, such as P100 graphite, are then coated with a metal-oxide film, such as silicon dioxide, and immersed in a molten metal bath, such as magnesium, resulting in good wetting and infiltration thereof.

An exemplary process for the preferred embodiment of fabricating graphite-fiber-reinforced metal-matrix composite consists of three major process steps including amorphous carbon coating, metal-oxide film and matrix formation as given infra.

In the first major process step of amorphorus carbon coating formation on the surface of the relatively high modulus fiber such as P100 graphite, the fiber bundles pass sequentially through the infra substeps:

first, the fibers are passed through a furnace having a temperature within a range of approximately three hundred fifty to four hundred fifty, but preferably four hundred degrees centigrade containing either a normal air atmosphere or preferably an inert gas atmosphere such as argon (Ar), wherein the fiber sizings, such as polyvinyl alcohol (PVA), are pyrolyzed and vaporized away; secondly, an ultrasonic bath containing an organic solvent, such as a toluene solution of pitch such as petroleum pitch, with a concentration within a range of approximately five to forty grams per liter and within a temperature range of approximately twenty to one hundred, but preferably thirty to fifty degrees centigrade; and thirdly, a series of multiple furnaces, preferably five or more, containing an inert gas atmosphere such as argon, at various predetermined increasing temperature levels from one hundred to eight hundred degrees centigrade, at a predetermined time within the range of five to fifteen minutes wherein the organic solvent is vaporized and the petroleum pitch is pyrolyzed. At this point, the surface of the graphite fiber has been uniformly coated as a layer to a predetermined depth of approximately less than one thousand angstroms with amorphous carbon.

In the second major process step of metal-oxide film formation on the coated surface of the graphite fiber, the fiber bundles are sequentially passed through: first, as ultrasonic bath containing an organic solvent of toluene solution including an alkoxide, such as tetraethoxy silane [$Si(OC_2H_5)_4$] (5% by volume) and a chloride such as silicon tetrachloride [$SiCl_4$] (5% by volume) at a predetermined temperature varying with a range from thirty to fifty degrees centigrade; secondly, a chamber containing flowing steam which hydrolyzes the alkoxide known here as tetraethoxy-silane and the chloride known as silicon chloride into the metal-oxide known as silicon dioxide [$SiO_2$] on the surface of the P100 graphite fiber; and thirdly, a drying furnace having a temperature within the range of approximately three hundred to seven hundred, but preferably six hundred and fifty degrees centigrade under an inert gas atmosphere such as argon wherein any excess water or organic solvent such as toluene is vaporized off and any unhydrolyzed metallic compounds such as silicon compounds are pyrolyzed to a metal-oxide such as silicon-dioxide.

In the third major process step of metal matrix formation on the coated and filmed surface of the P100 graphite fiber, the fibers are then passed through a molten metal bath using a metal such as magnesium or an alloy thereof under an inert gas atmosphere such as argon at a predetermined temperature within a range of approximately six hundred and fifty to seven hundred and fifty, but preferably approximately seven hundred degrees centigrade plus or minus thirty degrees for about ten seconds. The molten metal used in the metal matrix such as magnesium acts to wet the fiber coating and film, and infiltrates into the P100 graphite fiber bundles.

It will be appreciated that the present invention has application beyond P100 graphite or even carbon fibers, but wherever there is a need to adhere high modulus fibers to a metal matrix. It will be further appreciated that the present invention is not limited to magnesium and alloys thereof for the metal-matrix, but also may be used with aluminum, copper and alloys thereof to name a few of the possible metals.

Features of the invention include the use of pyrolyzed petroleum pitch as a surface coating for high modulus graphite fibers which leads to better metal matrix adhesion and bonding. In addition, the present invention provides for an inexpensive process for the fabrication of magnesium reinforced with very high modulus graphite fibers. It will also be noted that the present invention represents a method for providing a similar surface for many different types of fibers which allows them all to be processed into composites using very similar techniques.

From the foregoing description of a specific embodiment illustrating the fundamental features of the invention, it will now be apparent to those skilled in the art that the invention may be accomplished in a variety of forms without departing from the spirit and scope thereof. Accordingly, it is understood that the invention disclosed herein is a preferred embodiment thereof and that the invention is not to be limited thereby, but only by the appended claims.

What is claimed is:

1. A carbon fiber reinforced metal matrix composite comprising a. a continuous multifilament carbon fiber;

b. an amorphous carbon coating operative to be deposited as a relatively uniform layer on substantially all surfaces of said multifilament carbon fiber to a predetermined depth;

c. an oxide film that has been applied to the surface areas of said amorphous carbon coating; and d. a metal matrix infiltrated throughout and adhered to said multifilament carbon fiber.

2. The carbon fiber reinforced metal matrix composite as defined in claim 1 wherein said multifilament carbon fiber has a relatively high modulus and is substantially graphite.

3. The carbon fiber reinforced metal matrix composite as defined in claim 1 wherein said amorphous carbon coating is substantially pyrolyzed petroleum pitch.

4. The carbon fiber reinforced metal matrix composites defined in claim 1 wherein said oxide film is substantially silicon-dioxide.

5. The carbon fiber reinforced metal matrix composite as defined in claim 1 wherein said metal matrix is substantially magnesium.

6. The carbon fiber reinforced metal matrix composites defined in claim 1 wherein the predetermined depth of said amorphous carbon is approximately less than one thousand angstroms.

7. An improved process for the adhesion of an oxide film to a multifilament carbon fiber when bathed in a matrix metal in a liquidous state by coating the multifilament carbon fiber with amorphous carbon, comprising the steps of:

a. passing the multifilament carbon fiber through immersion containing an organic solvent having pitch at a predetermined temperature; and b. increasing incrementally the temperature through a predetermined range and within a given temporal period as applied to the multifilament carbon fiber for vaporizing the organic solvent and the pyrolyzing the pitch thereby uniformably coating on the surface of the multifilament carbon fiber to a predetermined depth of amorphous carbon.

8. The improved process of claim 7 wherein the organic solvent of the passing step is toluene.

9. The improved process of claim 7 whereon the pitch of the passing step is petroleum pitch.

10. The improved process of claim 7 wherein the predetermined temperatuure range of the passing step is within the range of approximately twenty to one hundred degrees centigrade.

11. The improved process of claim 7 wherein the predetermined temperature range of the increasing step is one hundred of eight hundred degrees centigrade.

12. The improved process of claim 7 wherein the predetermined time of the increasing step is within the range of one to fifteen minutes.

13. The improved process of claim 7 wherein the predetermined depth of the increasing step is approximately less than one thousand angstroms.

14. A process for improving the adhesion of an oxide film of multifilament carbon fiber during immersion in a molten metal by coating the multifilament carbon fiber with amorphous carbon, comprising the steps of:

a. heating the multifilament carbon fiber to a predetermined temperature for vaporizing and for pyrolyzing the fiber sizing;

b. disposing the multifilament carbon fiber in an ultrasonic containing an organic solvent having pitch at a predetermined temperature and concentration; and c. exposing the multifilament carbon fiber to continuously increasing increments of temperatures within a predetermined temperature range for a predetermined time for vaporizing the organic solvent and for pyrolyzing the pitch to form a relatively uniform layer of amorphous carbon to a predetermined depth on the surface of the multi-filament carbon fiber.

15. The process as defined in claim 14 wherein the predetermined temperature in the heating step is approximately within the range of three hundred and fifty to four hundred and fifty degrees centigrade.

16. The process as defined in claim 14 wherein the organic solvent in the disposing step is toluene.

17. The process as defined in claim 1 wherein the predetermined temperature in the disposing step is approximately within the range of twenty to one hundred degrees centigrade.

18. The process as defined in claim 14 wherein the concentration in the disposing step is approximately within the range of five to forty grams per liter.

19. The process as defined in claim 14 wherein the pitch in the disposing step is petroleum pitch.

20. The process as defined in claim 14 wherein the predetermined range of temperatures in the exposing step is from one hundred to eight hundred degrees centigrade and the predetermined time is within the range of one to fifteen minutes.

21. The process as defined in claim 18 wherein the predetermined depth of the exposing step is approximately less than one thousand angstroms.

22. In a process for improving the wettability of multifilament carbon fiber during immersion in a molten metal by coating with an oxide, depositing amorphous carbon on the multifilament carbon fiber precedent to the coating thereby facilitating the adhesion of the metal-oxide to the multifilament carbon fiber, comprising the steps of:

(a) treating thermally the multifilament carbon fiber within a range of three hundred and fifty to four hundred and fifty degrees centigrade for vaporizing and for pyrolyzing away the sizing of the multifilament carbon;

(b) fiber drawing the multifilament carbon fiber through an ultrasonic bath of toluene having petroleum pitch therein at a predetermined temperature approximately within the range of twenty to one hundred degrees centigrade; and (c) passing the multifilament carbon fibers through a range of continuously increasing temperatures from one hundred to eight hundred degrees centigrade within a temporal period of five to fifteen minutes for vaporizing the toluene and for pyrolyzing the petroleum pitch to form a relatively uniform layer of amorphous carbon to a depth of approximately less than one thousand angstroms on the surface of the multifilament carbon fiber.

* * * * *